US006880997B2

(12) United States Patent
Waguespack et al.

(10) Patent No.: US 6,880,997 B2
(45) **Date of Patent: *Apr. 19, 2005**

(54) LOCK SYSTEM FOR SECURING A PRINTER DOOR

(75) Inventors: John W. Waguespack, Redondo Beach, CA (US); Christopher E. Meyer, Fountain Valley, CA (US)

(73) Assignee: Security Works, Inc., Huntington Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/726,993

(22) Filed: Dec. 3, 2003

(65) Prior Publication Data

US 2004/0076459 A1 Apr. 22, 2004

Related U.S. Application Data

(63) Continuation of application No. 10/213,193, filed on Aug. 6, 2002, now Pat. No. 6,695,507.

(51) Int. Cl.[7] ..... B49J 29/02

(52) U.S. Cl. ..... 400/693; 292/137; 292/138.1; 70/159; 70/129

(58) Field of Search ..... 400/693; 292/137, 292/138.1; 70/159, 129

(56) References Cited

U.S. PATENT DOCUMENTS

| | | | |
|---|---|---|---|
| 3,711,894 | A | 1/1973 | Walters |
| 3,899,905 | A | 8/1975 | Walters |
| 4,095,828 | A | 6/1978 | East |
| 4,229,956 | A | 10/1980 | Thorburn |
| 4,452,476 | A | 6/1984 | Stole |
| 5,746,455 | A | 5/1998 | Takimoto |
| 5,853,205 | A | 12/1998 | Enomoto et al. |
| 6,019,402 | A | 2/2000 | Arabia, Jr. et al. |
| 6,301,941 | B1 | 10/2001 | Nicholsfigueiredo |
| 6,601,417 | B1 | 8/2003 | Cowper |

*Primary Examiner*—Andrew H. Hirshfeld
*Assistant Examiner*—Andrea H. Evans
(74) *Attorney, Agent, or Firm*—Stetina Brunda Garred & Brucker

(57) ABSTRACT

There is provided a lock system for securing a printer door to prevent theft of an ink cartridge. The lock system comprises a lock housing that is attachable adjacent the printer door and which has a lateral aperture extending generally parallel thereto. The lock system further comprises a locking member disposed within the lateral aperture and which is slidable therealong between unlock and lock positions. Its locking portion becomes substantially retracted within the lateral aperture when in the unlock position. The locking portion becomes extended over the printer door when in the lock position to secure the same and prevent theft of the ink cartridge thereby.

20 Claims, 2 Drawing Sheets

LOCK SYSTEM FOR SECURING A PRINTER DOOR

CROSS-REFERENCE TO RELATED APPLICATIONS

The present application is a continuation of U.S. patent application Ser. No. 10/213,193 entitled LOCK SYSTEM FOR SECURING A PRINTER DOOR filed Aug. 6, 2002, now U.S. Pat. No. 6,695,507 the entirety of the disclosures of which are expressly incorporated herein by reference.

STATEMENT RE: FEDERALLY SPONSORED RESEARCH/DEVELOPMENT (Not Applicable)

BACKGROUND OF THE INVENTION

The present invention relates generally to theft prevention devices, and more particularly to a lock device for a door of a printer, effective to prevent theft of an ink cartridge used by the printer.

Modern printers typically employ ink cartridges which mount upon an assembly internal to the printer. The assembly is operative to draw ink from the ink cartridge and deposit it upon a paper to be printed on. The ink supply of the ink cartridge is gradually depleted as printing is accomplished, and eventually a new ink cartridge is required in order to enable further printing.

In the case of some printers, the assembly is accessible only through resort to special tools or knowledge. In most cases, however, and particularly in the case of printers designed for use with personal computers, care is taken by the printer designers to ensure that the ink cartridge is more easily accessible by a user of the printer. In this regard, the ink cartridge is typically secured upon the assembly by means of a simple lever mechanism operable by hand.

Access to the assembly itself is often obstructed only by an external door of the printer. The only effective way to obstruct access to ink cartridges heretofore devised has therefore been to remove the ink cartridge from the printer and move it to a secure location. Obviously, this presents a substantial inconvenience, as the ink cartridge must be reinstalled into the printer before printing operations can resume, and removed again afterward.

There is moreover a noticeable trend for printer ink cartridges to be relatively high in cost. This is due in part to the fact that many ink cartridges are proprietary, and are available only from the manufacturer of the printer. Ink cartridges are typically also small in size. In particular, ink cartridges for ink jet printers are generally little larger than two inches on a side, and frequently much smaller. The combination of easy accessibility, high value and small size puts ink cartridges at an uncommonly high risk of theft.

Theft of ink cartridges is of special concern to governmental organizations and schools in particular. Schools generally employ personal computers and printers designed for use therewith. This is in part due to logistical concerns of the classroom setting, but also to the fact that part of the reason for having computer equipment in the classroom is to teach students how to use it. Since personal computer equipment is most likely the type the students will encounter later in life, it is the logical choice for the classroom.

As discussed above, printers designed for use with personal computers generally allow easy access to ink cartridges installed therein. Compounding the problem, however, is the fact the printers are likely to be of the same variety as are present in the students' own households. This makes the ink cartridges especially desirable to the students.

Moreover, students in their young age are less capable of realizing the consequences of their actions than adults. Finally, a typical classroom sees a periodic rotation of classes, so that the total number of students who spend time in the classroom is quite high. The aforementioned factors regarding the nature of ink cartridges and classrooms conspire to make theft of ink cartridges an especially serious problem in classrooms.

A need therefore exists for a device which can prevent theft of an ink cartridge while the ink cartridge is installed in a printer by obstructing access to the assembly upon which the ink cartridge is mounted.

BRIEF SUMMARY OF THE INVENTION

In accordance with a preferred embodiment of the present invention, there is provided a lock system for securing a door of a printer to prevent theft of an ink cartridge. The lock system comprises a lock housing which is sized and configured to be attached to the printer adjacent to its printer door. This housing defines a lateral aperture that extends generally parallel to the printer door.

The lock system further comprises a locking member disposed within the lateral aperture. It is adapted to be slidable along the lateral aperture between unlock and lock positions. The locking member includes a locking portion which becomes substantially retracted within the lateral aperture when the unlock position is formed. The same locking portion becomes extended over the printer door when the lock position is formed to secure the door and prevent theft of the ink cartridge thereby.

In the preferred embodiment of the present invention, the lock housing has a generally cylindrical configuration. Although such housing may be fabricated from any rigid material, the materials of choice are plastic and metal. Moreover, the locking member is an elongated bar which is preferably fabricated from a metallic material.

The lock housing defines a side housing surface. In addition, the locking member defines locking and unlocking ends each with a stopper. These stoppers are adapted to abut respective portions of the side housing surface to confine the slidability of the locking member between the unlock and lock positions.

In accordance with the preferred embodiment of the present invention, the lock system also comprises a lock device engaged within the lock housing. Such lock device forms a longitudinal aperture which extends generally perpendicular to the lateral aperture. The longitudinal and lateral apertures are placed in communication with each other.

More specifically, the lock device includes an engaging member which is disposed within the longitudinal aperture. The engaging member is adapted to be movable between disengaging and engaging positions. When the engaging member forms the disengaging position, its lower engaging portion is retracted within the longitudinal aperture. However, this lower engaging portion extends into the lateral aperture when the engaging member forms the engaging position.

The engaging member transitions to the engaging position for the purpose of holding the locking member in the lock position. More particularly, the locking member defines an arcuate notch wherein the lower engaging portion extends thereinto as the engaging position is formed. By doing so, the engaging member is able to restrict any sliding movement of the locking member. As such, the locking portion of the locking member can be maintained over the printer door so as to prohibit it from opening, thereby serving as an effective measure against theft of an ink cartridge contained within the printer.

BRIEF DESCRIPTION OF THE DRAWINGS

These as well as other features of the present invention will become more apparent upon reference to the drawings wherein.

DETAILED DESCRIPTION OF THE INVENTION

Figure 1:
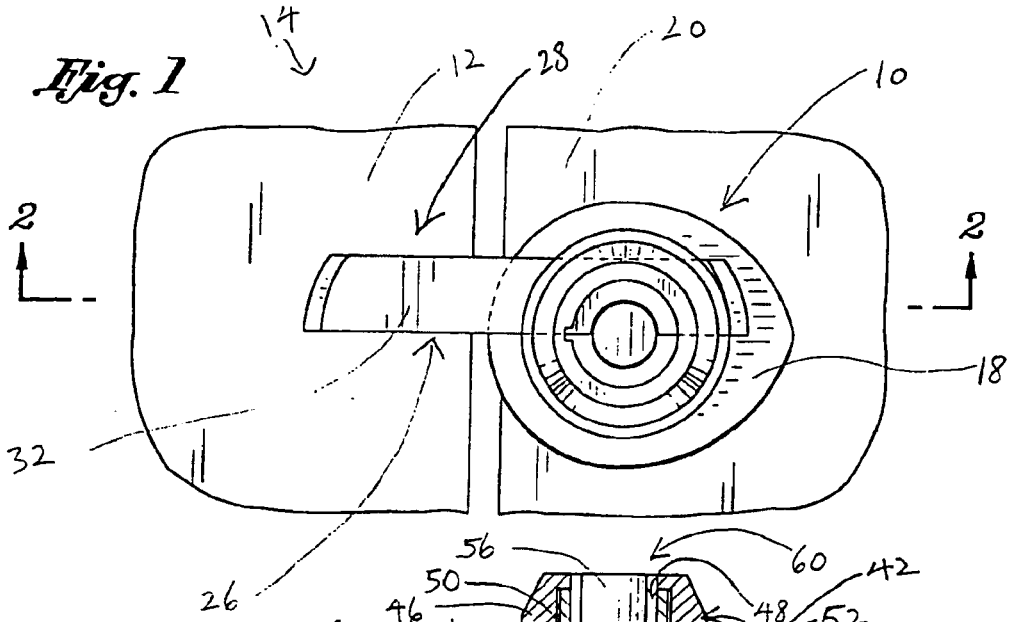
FIG. 1 is a plan view of a lock system constructed in accordance with a preferred embodiment of the present invention and illustrating its locking member utilized for securing a door of a printer.

Referring now to the drawings wherein the showings are for purposes of illustrating preferred embodiments of the present invention only, and not for purposes of limiting the same, FIG. 1 illustrates a lock system 10 constructed in accordance with a preferred embodiment of the present invention. The lock system 10 is adapted to secure a door 12 of a printer 14 so as to ultimately prevent theft of an ink cartridge (not shown) contained therein. However, it is expressly contemplated herein that such lock system 10 may be applied in other similar contexts such as securing a zip drive, a CD drive, a CD carousel and the like.

Figure 4:
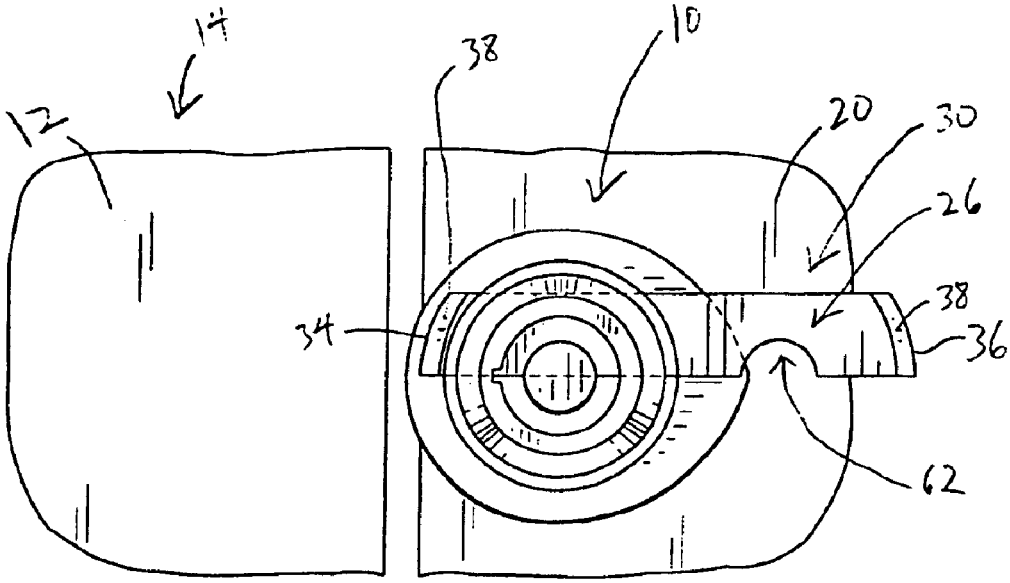
FIG. 4 is a plan view of the lock system of FIG. 1 and illustrating its locking member retracted in the unlock position so as to freely allow the door of the printer to open and close.
Figure 5:
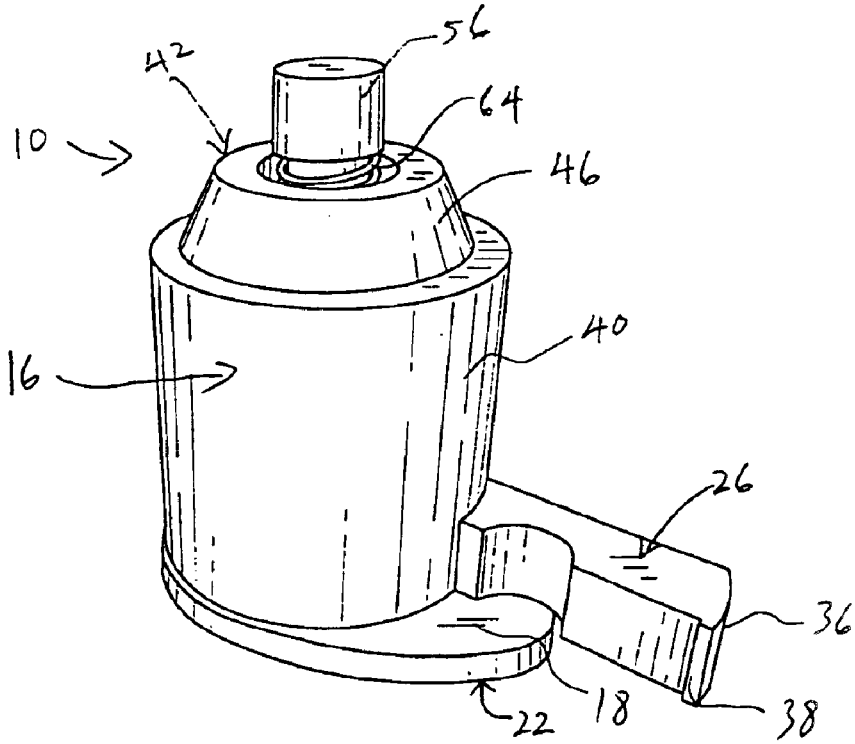
FIG. 5 is a perspective view of the lock system of FIG. 1 and illustrating an arcuate notch formed on its locking member which is used for retaining the locking member in the lock position.

Referring more particularly to FIGS. 1, 4 and 5, the lock system 10 includes a lock housing 16 which may be formed to have a variety of shapes, configurations, geometries and textures. Although the lock housing 16 is shown as having a generally cylindrical configuration in the provided figures, it is understood that the lock housing 16 as depicted is symbolic in nature. In addition, the lock housing 16 may be fabricated from any rigid material. However, such housing 16 is preferably made from either plastic or metal such as hardened steel or zinc alloy.

The lock housing 16 defines a base portion 18 which is used for attaching the lock housing 16 onto the printer 14 adjacent its printer door 12. In particular, this base portion i8 portrays an enlarged surface area sufficient to contact a printer body 20 of the printer 14 and maintain the lock housing 16 thereon. More particularly, the base portion 18 has a base surface 22 which is directly attached to the printer body 20. Although such attachment between the base surface 22 and the printer body 20 may be accomplished through a variety of procedures, it is preferred that the base surface 22 is adhered to the printer body 20 so that the lock system 10 can be conveniently and easily applied to an existing, conventional printer 14. Any glue or bond may be used for this purpose, but cyanoacrylate glue is preferred. Further, neoprene rubber mat (not shown) may be applied at the base surface 22 to establish tighter bond with the printer body 20.

Figure 2:
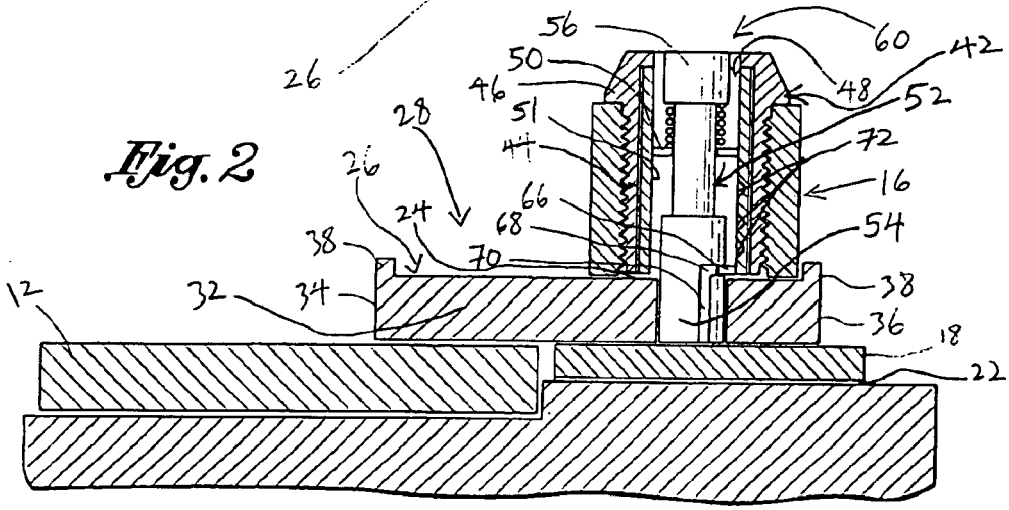
FIG. 2 is a cross-sectional view of the lock system of FIG. 1 and illustrating the locking member maintained in a lock position whereat its locking portion is extended over the door of the printer.
Figure 3:
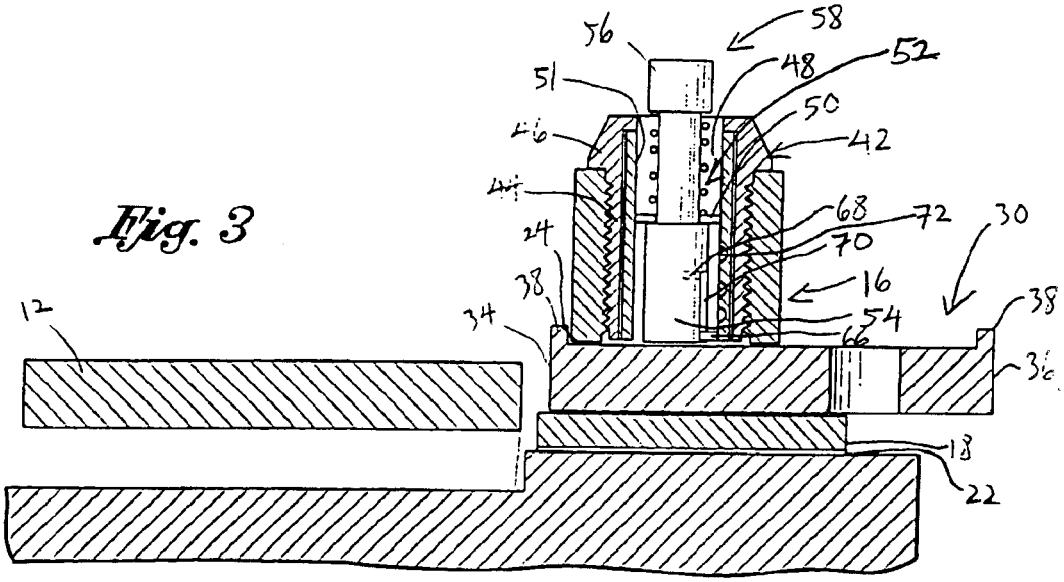
FIG. 3 is a cross-sectional view of the lock system of FIG. 1 and illustrating the locking member formed in an unlock position whereat its locking portion is retracted within the lock system.

Referring now to FIGS. 2 and 3, the lock housing 16 has a lateral aperture 24 therethrough. The lateral aperture 24 is formed in a manner as to extend in a generally parallel relationship with respect to the closed printer door 12 when the base surface 22 of the lock housing 16 is attached to the printer body 20. Slidably disposed within the lateral aperture 24 is an elongated locking member 26. As can be seen from the provided figures, the locking member 26 extends beyond the length of the lateral aperture 24. Although the locking member 26 can be any type of rigid structure which can strategically obstruct the printer door 12 from opening, it is preferably an elongated bar. This elongated bar should be constructed from a hardened material such as metal.

When no physical restraint is placed upon the locking member 26, the locking member 26 may freely slide along the lateral aperture 24 between a lock position 28 and an unlock position 30. Although the locking member 26 may be moved along the lateral aperture 24 through a variety of ways, it is preferably movable between the two positions 28, 30 by hand. The lock position 28 is formed when the locking member 26 manually slides towards the printer door 12 so that a portion thereof can extend over and block the printer door 12 from opening. That portion of the locking member 26 which extends over the printer door 12 is defined as a locking portion 32. When the locking member 26 manually slides in an opposite direction, that is, away from the printer door 12, the unlock position 30 is formed whereat the locking portion 32 is substantially retracted within the lateral aperture 24.

Referring now to FIGS. 2, 3 and 5, the locking member 26 defines a locking end 34 (disposed toward the printer door 12) and an unlocking end 36 (disposed away from the printer door 12). The locking and unlocking ends 34, 36 are each provided with a stopper 38 which are essentially protrusions that extend vertically upward relative to their respective ends 34, 36 (best shown in FIGS. 2 and 3). Alternatively, however, these stoppers 38 may be formed to extend sidewardly with respect to the locking and unlocking ends 34, 36 (best shown in FIG. 5).

Regardless of their extension, the stoppers 38 are designed to abut respective portions of the lock housing 16 for the purpose of confining the slidability of the locking member 26 between the lock and unlock positions 28, 30. More specifically, the stopper 38 formed at the unlocking end 36 engages the adjacent side housing surface 40 of the lock housing 16 in abutting contact to prevent the locking member 26 from sliding out of the lateral aperture 24 beyond the lock position 32. In the similar fashion, the stopper 38 formed at the locking end 34 engages the adjacent side housing surface 40 in abutting contact to also prevent the locking member 26 from sliding out beyond the unlock position 30.

Referring now back to FIGS. 2 and 3, a lock device 42 which is adapted to maintain the locking member 26 in the lock position 32 is provided within the lock housing 16. The lock device 42 comprises an embedded device portion 44 and an exposed device portion 46. The embedded device portion 44 of the lock device 42 is embedded within the lock housing 16 while its exposed device portion 46 is exposed outside thereof.

A longitudinal aperture 48 is provided within the lock device 42 which extends longitudinally between the exposed device portion 46 and the embedded device portion 44. This aperture 48 is placed in communication with the lateral aperture 24 and forms a generally perpendicular relationship therewith. A stationary support surface 50 is engaged to the lock device's internal device surface 51 so as to be disposed within the longitudinal aperture 48 about the embedded device portion 44 of the lock device 42.

Disposed within the longitudinal aperture 42 through the support surface 50 is an engaging member 52 having a lower engaging portion 54 and an upper engaging portion 56. Preferably, the engaging member 52 is a cylindrical rod. However, as will be described below, it is recognized herein that other configurations which may sufficiently engage and maintain the locking member 26 in the lock position 28 may be used. The engaging member 52 is movable along the longitudinal aperture 48 between a disengaging position 58 and an engaging position 60. In the disengaging position 58, the lower engaging portion 54 of the engaging member 52 is substantially retracted within the longitudinal aperture 48 whereby the upper engaging portion 56 is protruded out of the exposed device portion 46. The engaging member is preferably spring loaded so that it is naturally biased in the disengaging position 58.

To form the engaging position 60, the upper engaging portion 56 is preferably pushed in by hand into the longitudinal aperture 48 which in turn causes the lower engaging portion 54 to extend into the lateral aperture 24. To allow such extension, the locking member 26 should be placed in the lock position 32 where it provides an arcuate notch 62 which aligns with and receives the lower engaging portion 54 therethrough. The arcuate notch 62 should be sized in a manner as to securely maintain the lower engaging portion 54 therewithin so that the locking member 26 as a whole becomes substantially immovable by the insertion of the lower engaging portion 54. It should be noted that other types of configurations such as a hollow bore formed through the locking member 26 may be used for receiving the lower engaging portion 54 in lieu of the arcuate notch 62.

As shown in FIGS. 2, 3 and 5, the upper engaging portion 56 of the engaging member 52 may be manually pushed into the longitudinal aperture 48 in order to introduce the lower engaging portion 54 into the lateral aperture 24 and thus through the arcuate notch 62. Such task would be done against the spring force of a compression spring 64 trapped between the stationary support surface 50 and the upper engaging portion 56. Once pushed in, a lateral protrusion 66 which is engaged to the internal device surface 51 and which further protrudes into the longitudinal aperture 48 becomes caught in the lateral groove portion 68 of the groove 70 formed in the lower engaging portion 54. This arrangement allows the lower engaging portion 54 to be maintained in the engaging position 60 against the force of the compression spring 64.

In order to retract the lower engaging portion 54 back into the longitudinal aperture 48 and thus form the disengaging position 58, a specifically configured key (not shown) which corresponds with the key notches 72 formed on the internal device surface 51 may be inserted into the longitudinal aperture 48. Such key would securely mate with the key notches 72 and be twisted so that the internal device surface 51 of the lock device 42 may rotate and dislodge the lateral protrusion 66 from the lateral groove portion 68. Once the lateral protrusion 66 becomes dislodged due to such rotation via a key, the engaging member 52 reflexes back to the disengaging position 58 by the spring force of the compression spring 64. The groove 70 of the lower engaging portion 54 accommodates the lateral protrusion 66 during this process so as to allow the lateral protrusion 66 to slip therethrough while the engaging member 52 reflexes back.

As noted above, the objective of the lock device 42 is to hold and maintain the locking member 26 in the lock position 28. In this respect, it may be foreseeable to use different types of lock devices (e.g., cylinder locks, cam locks, etc.) to accomplish this objective. Moreover, it may be further foreseeable to incorporate a preexisting, conventional lock device into the lock housing 16 so as to be used for retaining the locking member 26 in the lock position 28. An exemplary conventional lock device that may be incorporated is a lock labeled Part No. 615 from ABA Locks Manufacturer Co., Ltd. of Taipei, Taiwan.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A lock system for securing a printer door to prevent theft of an ink cartridge, the lock system comprising:

a lock housing attachable adjacent the printer door and having a lateral aperture extending generally parallel thereto;

a lock device disposed within the lock housing; and a locking member with a locking portion disposed within the lateral aperture and being slidable therealong between unlock and lock positions, the lock device being selectively engageable to and disengageable from the locking member, the locking portion substantially retracting within the lateral aperture when the lock device disengages from the locking member forming the unlock position, the locking portion extending over the printer door when the lock device engages the locking member forming the lock position to secure the same and prevent theft of the ink cartridge thereby.

2. The lock system of claim 1 wherein the locking member is fabricated from a metallic material.

3. The lock system of claim 1 wherein the locking member is an elongated bar.

4. The lock system of claim 1 wherein the lock housing has a side housing surface and the locking member has locking and unlocking ends each with a stopper, each of the stoppers being configured to abut respective portion of the side housing surface to confine the slidability of the locking member between the unlock and lock positions.

5. The lock system of claim 1 wherein the lock device comprises a longitudinal aperture in communication with the lateral aperture and extending generally perpendicular thereto, the lock device having an engaging member with a lower engaging portion disposed within the longitudinal aperture and being movable between disengaging and engaging positions, the lower engaging portion retracting within the longitudinal aperture when forming the disengaging position, the lower engaging portion extending into the lateral aperture and being sized and configured to maintain the locking member in the lock position when forming the engaging position.

6. The lock system of claim 5 wherein the locking member comprises an arcuate notch and the lower engaging portion extends thereinto when forming the engaging position.

7. A printer with a lock system for preventing theft of an ink cartridge, the printer comprising:

a printer body having a printer door sized and configured to open and close with respect thereto; and a lock system comprising:

a lock housing attached to the printer body adjacent the printer door thereof, the lock housing having a lateral aperture extending generally parallel to the printer door;

a lock device disposed within the lock housing; and a locking member with a locking portion disposed within the lateral aperture and being slidable therealong between unlock and lock positions, the lock device being selectively engageable to and disengageable from the locking member, the locking portion substantially retracting within the lateral aperture when the lock device disengages from the locking member forming the unlock position, the locking portion extending over the printer door when the lock device engages the locking member forming the lock position to secure the same and prevent theft of the ink cartridge thereby.

8. The printer of claim 7 wherein the locking member is an elongated bar.

9. The printer of claim 7 wherein the locking member is fabricated from a metallic material.

10. The printer of claim 7 wherein the lock housing has a side housing surface and the locking member has locking and unlocking ends each with a stopper, each of the stoppers being configured to abut respective portion of the side housing surface to confine the slidability of the locking member between the unlock and lock positions.

11. The printer of claim 7 wherein the lock housing has a base housing surface, the base housing surface being attached to the printer body via adhesive.

12. The printer of claim 7 wherein the lock device comprises a longitudinal aperture in communication with the lateral aperture and extending generally perpendicular thereto, the lock device having an engaging member with a lower engaging portion disposed within the longitudinal aperture and being movable between disengaging and engaging positions, the lower engaging portion retracting within the longitudinal aperture when forming the disengaging position, the lower engaging portion extending into the lateral aperture and being sized and configured to maintain the locking member in the lock position when forming the engaging position.

13. The lock system of claim 12 wherein the locking member comprises an arcuate notch and the lower engaging portion extends thereinto when forming the engaging position.

14. A lock system for securing a printer door to prevent theft of an ink cartridge, the lock system comprising:

a lock housing attachable adjacent the printer door and having a lateral aperture extending generally parallel thereto, the lock housing having a side housing surface; and a locking member with a locking portion disposed within the lateral aperture and being slidable therealong between unlock and lock positions, the locking portion substantially retracting within the lateral aperture when in the unlock position, the locking portion extending over the printer door when in the lock position to secure the same and prevent theft of the ink cartridge thereby, wherein the locking member has locking and unlocking ends each with a stopper, each of the stoppers being configured to abut respective portion of the side housing surface to confine the slidability of the locking member between the unlock and lock positions.

15. The lock system of claim 14 wherein the locking member is fabricated from a metallic material.

16. The lock system of claim 14 wherein the locking member is an elongated bar.

17. The lock system of claim 14 wherein the lock housing is fabricated from a metallic material.

18. The lock system of claim 14 further comprising a lock device engaged within the lock housing and being sized and configured to maintain the locking member in the lock position.

19. The lock system of claim 18 wherein the lock device comprises a longitudinal aperture in communication with the lateral aperture and extending generally perpendicular thereto, the lock device having an engaging member with a lower engaging portion disposed within the longitudinal aperture and being movable between disengaging and engaging positions, the lower engaging portion retracting within the longitudinal aperture when forming the disengaging position, the lower engaging portion extending into the lateral aperture and being sized and configured to maintain the locking member in the lock position when forming the engaging position.

20. The lock system of claim 14 wherein the locking member comprises an arcuate notch and the lower engaging portion extends thereinto when forming the engaging position.

* * * * *